US005667210A

United States Patent [19]

DeLise, Jr.

[11] Patent Number: 5,667,210

[45] Date of Patent: Sep. 16, 1997

[54] FOLDED LEAFLET AND METHOD AND APPARATUS FOR MAKING SAME

[75] Inventor: Stephen W. DeLise, Jr., West Islip, N.Y.

[73] Assignee: Freeport Miniature Folding Company Inc.

[21] Appl. No.: 418,184

[22] Filed: Apr. 7, 1995

[51] Int. Cl.[6] ..... B41L 43/12; B42D 3/18

[52] U.S. Cl. ..... 270/37; 270/51; 493/436; 493/444; 281/5

[58] Field of Search ..... 270/37, 45, 51; 493/458, 331, 436, 437, 438, 444, 445, 446; 53/429; 281/2, 5; 283/34, 61, 62, 81

[56] References Cited

U.S. PATENT DOCUMENTS

| | | | |
|---|---|---|---|
| 1,239,965 | 9/1917 | Reinhold | 493/458 X |
| 1,326,859 | 12/1919 | Grammer | 270/45 |
| 2,751,222 | 6/1956 | Dexter | 493/458 X |
| 3,773,314 | 11/1973 | Giovannini | 493/458 X |
| 4,010,299 | 3/1977 | Hershey, Jr. et al. | 281/5 X |
| 4,097,067 | 6/1978 | Schecchter | 283/62 X |
| 4,229,926 | 10/1980 | Rowling | 53/429 |
| 4,270,742 | 6/1981 | Kobayashi | 270/37 |
| 4,583,763 | 4/1986 | Shacklett, Jr. | 281/2 X |
| 4,616,815 | 10/1986 | Vijuk . | |
| 4,660,856 | 4/1987 | Shacklett, Jr. | 281/5 |
| 4,812,195 | 3/1989 | Vijuk . | |
| 4,817,931 | 4/1989 | Vijuk | 270/37 |
| 4,905,977 | 3/1990 | Vijuk . | |
| 5,044,873 | 9/1991 | Vijuk . | |
| 5,046,710 | 9/1991 | Vijuk | 270/37 |
| 5,458,374 | 10/1995 | Vijuk et al. | 283/81 |

*Primary Examiner*—Hoang Nguyen
*Attorney, Agent, or Firm*—Collard & Roe, P.C.

[57] ABSTRACT

A folded medical outsert and method and apparatus for making same. The outsert consists of a printed sheet provided with a series of parallel fold lines. A first cross fold divides the sheet in half. Two off-center cross folds are then provided with an adhesive securing the last folded flap in place. The apparatus for folding the printed sheet includes a parallel folder and a cross folder to form the first and second cross folds. An adhesive applicator dispenses an adhesive before a knife folder performs the third cross fold. The method for forming the outsert includes the steps of forming a series of parallel fold lines. The first cross fold is then formed perpendicular to the parallel fold lines to divide the sheet into half. The second cross fold is then formed in the sheet following which an adhesive is dispensed onto the sheet. The third cross fold is then formed between the first cross fold and the second cross fold to provide a closed secured outsert.

9 Claims, 4 Drawing Sheets

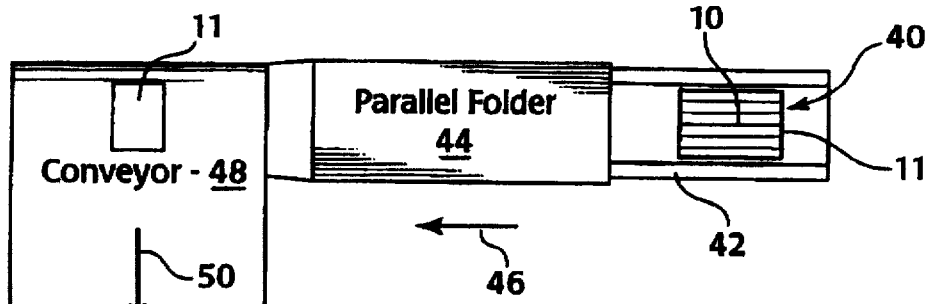
Fig. 6
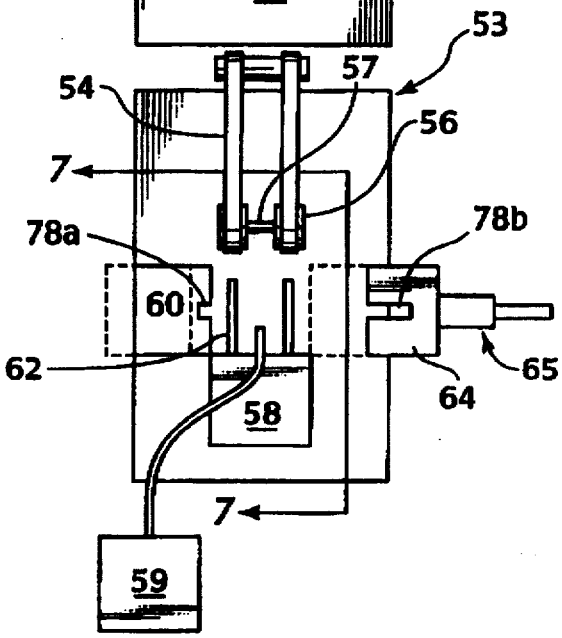
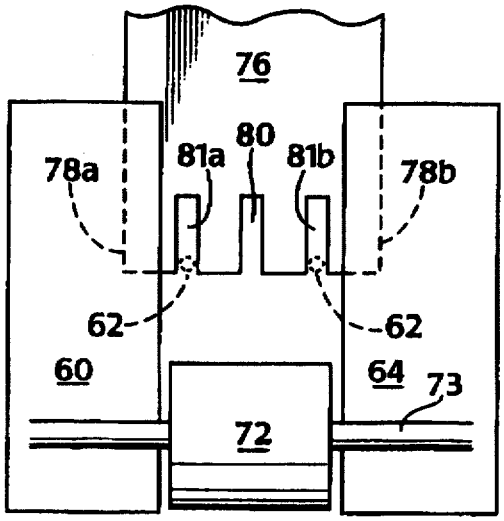
Fig. 8
Fig. 7
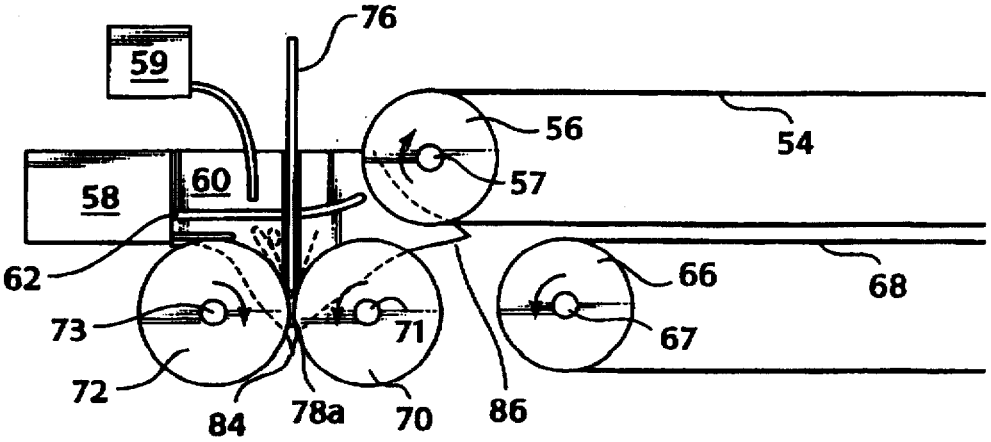

FOLDED LEAFLET AND METHOD AND APPARATUS FOR MAKING SAME

BACKGROUND OF THE INVENTION

1. Field of the Invention

The present invention relates to a folded leaflet and to a method and apparatus for making same. More particularly, it relates to high speed, automated processing of medical outserts.

2. Prior Art

Medical outserts are made by folding printed sheets into miniature secured packets which are issued with pharmaceutical products. High speed operations dispense the outsert in a packaging operation for the pharmaceutical products. Due to the high speed of the packaging operation, the outsert must have all loose edges secured so that it is reliably dispensed during the packaging operation. The outserts are delivered in stacks or columns with a folded edge intended to serve as a leading edge when entering the packaging operation. During the last fold of the outsert, the opposed panels are adhered together resulting in a secured outsert which can reliably be loaded into the packaging operation.

As can be appreciated, the reliability of the outsert is dependent on the uniformity and alignment of the various folds which convert the printed sheet into the miniature folded, secured leaflet. An example of prior art leaflets and methods and apparatus for making same can be seen in U.S. Pat. Nos. 4,817,931 and 5,046,710. However, these patents only show two initial parallel folds in FIGS. 4 and 5. These patents then describe an off-center cross fold, resulting in a short leg, followed by a final cross fold. The leaflet is then glued together beyond the short leg formed by the first off-center cross fold. As the size of the printed sheet increases, numerous additional folds are required to provide the same size miniature leaflet. Aligning the numerous folds results in a complexity of operations which is not addressed in the above-referenced patents. Accordingly, it would be desirable to provide an outsert where the final folds are carefully aligned to produce a highly reliable, secured outsert.

SUMMARY OF THE INVENTION

It is therefore an object of the present invention to overcome the drawbacks of the prior art and to provide a secured outsert with carefully aligned folds and panels.

It is a further object of the present invention to provide a method and apparatus for manufacturing the secured outserts.

These and other related objects are achieved according to the invention by a folded, closed leaflet formed from a printed sheet having a longitudinally extending edge. The leaflet consists of a plurality of parallel fold lines formed in the sheet dividing the sheet into overlapping strips. Each of the parallel fold lines extends between a first free end and a second spaced opposite free end. A first cross fold is made perpendicular to the plurality of parallel fold lines forming substantially equal halves of the strip and positioning a second free end adjacent a first free end to form a combined free end. The combined free end borders a first panel and the first cross fold borders a second panel with a third panel disposed therebetween. A second cross fold superimposes the first panel onto the third panel. A third cross fold superimposes the second panel onto the first panel with the combined free end being sandwiched between the second and third panels. An adhesive interior of the leaflet joins the second panel to the first panel to form the closed leaflet.

The plurality of parallel fold lines are parallel to the longitudinally-extending edge of the printed sheet. The first, second and third panels are of approximately equal square size. The first cross fold is adjacent the second cross fold, and the combined free edge is adjacent the third cross fold.

Alternatively, the third cross fold superimposes a first portion of the first and third panels onto a second portion of the first and third panels. A fourth cross fold superimposes the second panel onto the superimposed first and third panels. An adhesive interior of the leaflet joins the second panel to the third panel to form the closed leaflet.

According to the invention, there is also provided an apparatus for folding a printed sheet, having a longitudinally-extending edge into a closed, secured outsert. The apparatus consists of parallel folding means forming a plurality of parallel fold lines in the sheet to divide the sheet into overlapping strips and discharging the sheet in a first direction perpendicular to the parallel fold lines. A conveyor feeds the folded sheet in a second direction perpendicular to the first direction. A cross folder forms a first cross fold in the sheet perpendicular to the parallel fold lines to divide the sheet into substantially equal halves, including a free end opposite the first cross fold. The cross folder then forms a second cross fold in the sheet. The cross folder then discharges the sheet in the second direction with the second cross fold facing the second direction. The first cross fold faces away from the second direction with the free end positioned therebetween. An adhesive applicator then dispenses an adhesive onto a section of the sheet. A blade folder forms a third cross fold between the first and second cross folds to enclose the free end and the adhesive before discharging the closed, secured outsert in a second direction.

The parallel folder forms the parallel fold lines parallel to the longitudinally extending edge which is parallel to the second direction. The blade folder forms the third cross fold adjacent the free end and positions the first cross fold adjacent the second cross fold. The apparatus additional includes means for supporting a plurality of printed sheets in a stack and individually feeding the sheets to the parallel folder. The apparatus further includes means for stacking the closed, secured outserts in a row or column.

The blade folder includes a stationary front stop for contacting the second cross fold and positioning the sheet along the second direction. Two side tampers contact the parallel fold lines and position the sheet along the first direction. The first and second fold rollers are rotatably mounted on the first and second roller axles and positioned below the tampers. The roller axles extend parallel to the first direction. A blade is slidably supported by the two side tampers for creasing the sheet and feeding the sheet from the tampers to the rollers. The rollers rotate in opposite directions to draw the sheet in between the rollers. The blade folder further includes an input pulley rotatably mounted on a pulley axle and positioned generally above the first fold roller for feeding the sheet toward the front stop. Each of the side tampers has a first nib extending between the pulley axle and the first roller axle. A second nib extends downwardly between the first roller axle and the second roller axle.

The side tampers are both reciprocating side tampers which extend toward and retract away from each other. The reciprocating side tampers are retracted when the sheet is fed into the folder and then extend to press the sheet therebetween to align the parallel folds and the overlapping strips before creasing the sheet. Alternatively, one of the side tampers is a stationary side tamper and the other is a reciprocating side tamper which extends toward and retracts away from the stationary side tamper. The reciprocating side tamper is retracted when the sheet is fed into the blade folder and extends to press the sheet against the stationary side tamper and align the parallel folds before creasing the sheets. A cantilevered top guide is connected to the stationary front stop and extends toward the input pulley to contact and guide the sheet. The blade includes a first aperture for accommodating the top guide and a second aperture for aligning with the adhesive to avoid contact therewith.

In a further embodiment, the apparatus includes cross folding means for forming a first cross fold in the sheet perpendicular to the parallel fold lines to divide the strips into substantially equal halves including a free end opposite the first cross fold. The cross folder then forms at least one intermediate cross fold in the sheet including a penultimate fold. The sheet is then discharged in the second direction with the penultimate fold facing the second direction.

Also according to the invention there is disclosed a method for folding a printed sheet with a longitudinally extending edge into a closed, secured outsert. The method comprises the steps of forming a plurality of parallel fold lines in the sheet to divide the sheet into overlapping strips. A first cross fold is formed perpendicular to the parallel fold lines to divide the strips into substantially equal halves including a free end opposite the first cross fold. A second cross fold is formed in the sheet to position the free end between the first cross fold and the second cross fold. An adhesive is dispensed onto a section of the sheet. A third cross fold is formed between the first cross fold and the second cross fold to enclose the free end and the adhesive to provide a closed, secure outsert.

The parallel fold lines are parallel to the longitudinally extending edge. The first, second and third cross folds are parallel to each other and perpendicular to the longitudinally-extending edge. The third cross fold is adjacent the free end and positions the first cross fold adjacent the second cross fold.

Individual sheets are initially fed from a stack. The closed secured outserts are stacked in a row or column subsequent to processing. Forming the third cross folds consists of positioning or delivering the sheet into an alignment apparatus with the second cross fold placed against a stationary front stop. A pair of reciprocating side tampers are then slid against opposed parallel folds to align the parallel folds with each other and to align the overlapping strips with each other. The sheet is creased to form the third cross fold and fed into a set of fold rollers with the third cross fold initially facing the fold rollers. Alternatively, the third cross fold consists of positioning or delivering the sheet into an alignment apparatus with the second cross fold placed against the stationary front stop and at least one of the parallel folds placed adjacent a stationary side tamper. A reciprocating side tamper is slid against the remaining parallel folds to press the sheet against the stationary side tamper. The sheet is creased to form the third cross fold. The creased sheet is fed into a set of fold rollers, wherein the third cross fold initially faces the fold rollers. The step of creasing the sheet consists of providing a folder blade with an operating edge and two sides adjacent the operating edge. The two sides of the folder blade are supported within slots formed in the side tampers. The operating edge of the folder blade is slid against the sheet to move the sheet out of the alignment apparatus and into the fold rollers.

Alternatively, the method consists of forming at least one intermediate fold in the sheet, following the step of forming a first cross fold. An adhesive is dispensed onto a section of the sheet. A final blade fold is formed adjacent the first cross fold to enclose the free end and the adhesive to provide a closed, secured outsert.

BRIEF DESCRIPTION OF THE DRAWINGS

Other objects and features of the present invention will become apparent from the following detailed description considered in connection with the accompanying drawings which disclose several embodiments of the present invention. It should be understood, however, that the drawings are designed for the purpose of illustration only and not as a definition of the limits of the invention.

In the drawings, wherein similar reference characters denote similar elements throughout the several views:

FIG. 6 is a top plan view of the apparatus according to the invention;

FIG. 7 is a cross sectional view taken along the line 7—7 from FIG. 6;

FIG. 8 is a front side elevational view of the knife and side tampers of the apparatus;

DETAILED DESCRIPTION OF PREFERRED EMBODIMENTS

Figure 1:
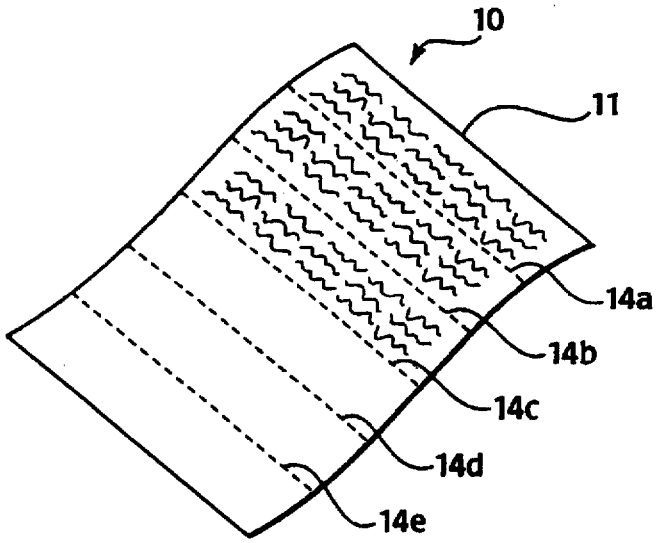
FIG. 1 is a perspective view of a printed sheet to be formed into a medical outsert.
Figure 2A:
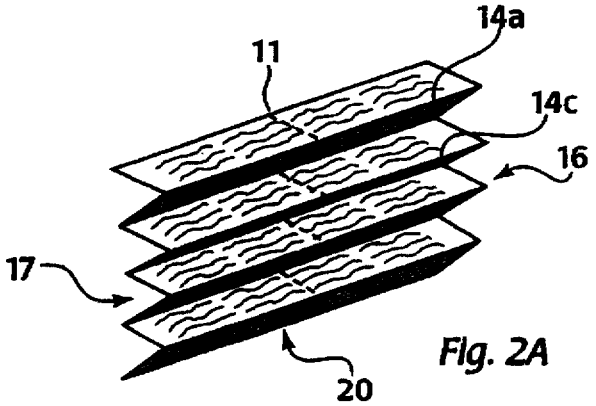
FIG. 2A is a perspective view of the printed sheet provided with a series of parallel accordion folds.
Figure 2B:
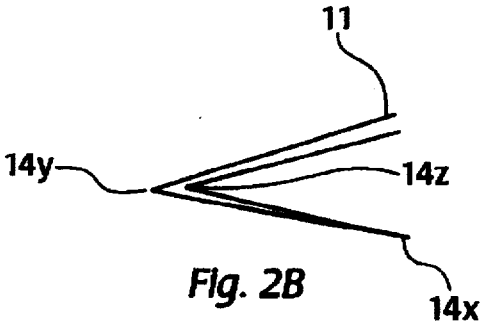
FIG. 2B is a left side elevational view of the printed sheet provided with a series of parallel overlap folds.

Turning now in detail to the drawings, and in particular FIGS. 1, 2A, 2B, 3A, 4A and 5A, there is shown a printed sheet 10 which will be folded into a closed secured pharmaceutical outsert to be enclosed in the packaging of a pharmaceutical product. Printed sheet 10 may be provided in a variety of sizes, the most common being rectangular with a longitudinal extending edge 11. Initially, a series of parallel fold lines 14*a*, 14*b*, 14*c*, 14*d* and 14*e* are made in printed sheet 10 to reduce the sheet down to the desired final width. In other words, each of the overlapping strips between adjacent fold lines possess the requisite width of the completed outsert. FIG. 2A shows an accordion type fold with each of the fold lines being parallel to each other and edge 11. FIG. 2B shows an alternate embodiment where the folds are overlapping. For example, the sheet is first folded in half at parallel fold line 14*x*. The sheet is then folded in half again to simultaneously create parallel fold lines 14*y* and 14*z*. Parallel fold lines 14*x*, 14*y*, and 14*z* are still parallel to each other and edge 11. In addition, the overlapping strips shown in FIG. 2B have the same width as the final outsert. It should also be noted that overlapping folds and accordion folds may be combined in any suitable manner.

Figure 3A:
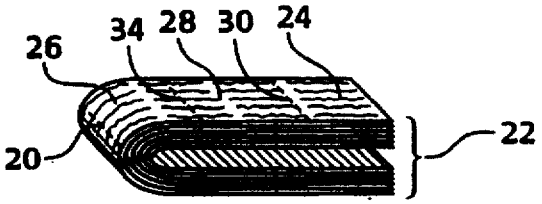
FIG. 3A is a perspective view of the printed sheet folded in half.
Figure 4A:
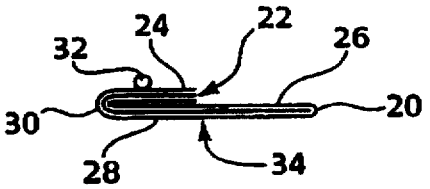
FIG. 4A is a front side elevational view of the printed sheet from FIG. 3A with a second cross fold and an adhesive.
Figure 5A:
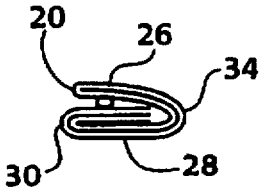
FIG. 5A is a front side-elevational view of the printed sheet from FIG. 4A with a third cross fold enclosing the free end and the adhesive.

Referring now to FIGS. 2A and 3A, the sheet is cross folded in half along a first cross fold line 20. This bring right free end 16 and left free end 17 adjacent to each other to form a combined free end 22 opposite fold line 20. As can be seen in FIG. 3A, the sheet is now divided into a first panel 24, a second panel 26, and a third panel 28 separated by second cross fold line 30 and third cross fold line 34. Panels 24, 26 and 28 have similar square shapes and similar sizes, for example. First panel 24 is folded at second cross fold line 30 onto third panel 28, as can be seen in FIG. 4A. An adhesive 32 is applied to the upward face of first panel 24. Second panel 26 is now folded at third cross fold line 34 onto panels 24 and 28, as can be seen in FIG. 5A. The resulting outsert includes third cross fold line 34 on one edge with first cross fold line 20 and second cross fold line 30 at the opposite edge. The intermediate edges consist of parallel fold lines. The combined free end 22 is secured within the outsert so that it may be handled by high speed processing equipment with fold line 34 used as a leading edge.

In a practical embodiment, sheet 10 is a 6¼"×9½" printed sheet which is subjected to 8 parallel folds resulting in a 1"×6¼" product, as shown in FIGS. 2A and 2B. The sheet is then folded in half to obtain a 1"×3⅛" product, as shown in FIG. 3A. After panels 24 and 26 are folded in, a uniform 1"×1" outsert remains with only folded edges on the exterior thereof.

Figure 3B:
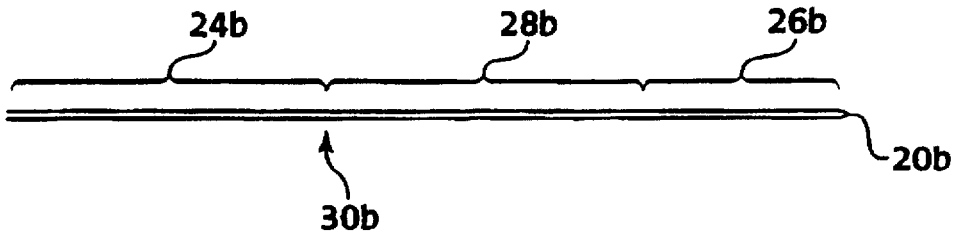
FIG. 3B is a left side elevational view of an alternate sheet folded in half.
Figure 3C:
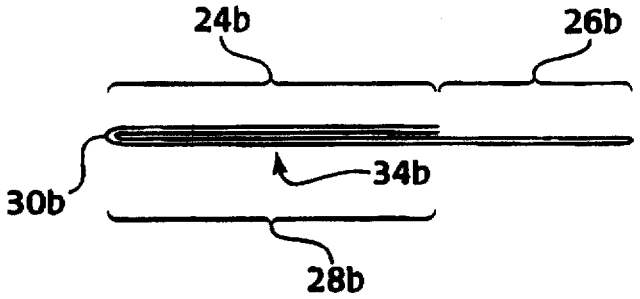
FIG. 3C is a left side elevational view of the alternate sheet from FIG. 3B with a second cross fold.
Figure 4B:
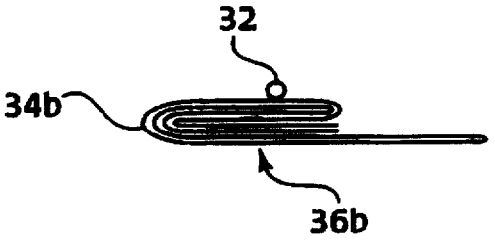
FIG. 4B is a left side elevational view of the alternate sheet from FIG. 3C with a third cross fold and an adhesive.
Figure 5B:
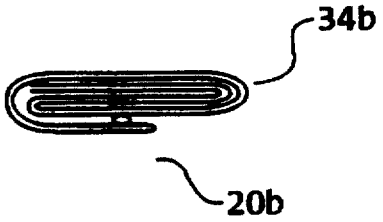
FIG. 5B is a left side elevational view of the alternate sheet from FIG. 4B with a fourth cross fold enclosing the adhesive.

In an alternate embodiment, the parallel folded sheet, from FIGS. 2A or 2B is cross folded at a first cross fold line 20*b*, as shown in FIG. 3B. The sheet is divided into a first panel 24, a second panel 26, and a third panel 28. If the sheet is theoretically divided into fifths, first panel 24*b* would include two-fifths of the sheet, second panel 26*b* would include one-fifth of the sheet, and third panel 28*b* would include the remaining two-fifths of the sheet. The sheet is folded at second cross fold line 30*b* so that first panel 24 is superimposed onto third panel 28*b*. First panel 24*b* completely overlaps third panel 28*b* as they are of the same size and shape. Panels 24*b* and 28*b* are then folded in half at third cross fold line 34*b*. An adhesive 32 is then applied to the upward surface before the last fold at final cross fold line 36*b*, as can be seen in FIGS. 4B and 5B. In practice, a sheet which is initially ten units long is reduced to a length of five units in FIG. 3B. The sheet is further reduced a length of three units in FIG. 3C and then two units in FIG. 4B. The last fold at 36*b* encloses the free end and the adhesive to provide a secured outsert which is one unit square.

FIG. 6 shows the apparatus according to the invention wherein a large number of printed sheets 10 are arranged in a stack 40 on a sheet feeder 42. Individual sheets are fed from stack 40 into a parallel folder 44 in a first direction 46. Parallel folder 44 may execute any number of overlapping or accordion type parallel folds. The parallel folded sheet is then transported on a conveyer 48 in a second direction 50, which is perpendicular to first direction 46. Sheet 10 enters a cross folder 52 which imparts one or more buckle folds onto the sheet. A blade folder 53 has an intake mechanism consisting of an upper belt 54 supported on pulleys, including an upper pulley 56 which is rotatably mounted on an upper pulley axle 57, as can be seen in FIGS. 6 and 7. One or more lower belts 68 is supported on pulleys including a lower pulley 66 which is rotatably mounted on a pulley axle 67. The folded sheet is fed between belts 54 and 68 into an alignment apparatus. The direction of rotation of pulleys 56 and 66 and fold roller 70 ensures that the folded sheet is reliably delivered into the alignment apparatus. More specifically, the leading edge of the sheet, for example, cross fold 30 or 34*b* enters the alignment apparatus and contact front stop 58 for positioning along direction 50. The sheet rests on top of fold rollers 70 and 72 and is held in place on top by a top guide 62. Optionally, a plate extends from stop 58 over the top part of fold roller 72 to keep the sheet in place and prevent it from being displaced by the clockwise rotation of fold roller 72. Top guide 62 is mounted to front stop 58 and cantilevers rearwardly toward upper pulley 56. The free end of top guide 62 curves upwardly to avoid snagging the sheet as it enters the alignment apparatus.

Figure 10:
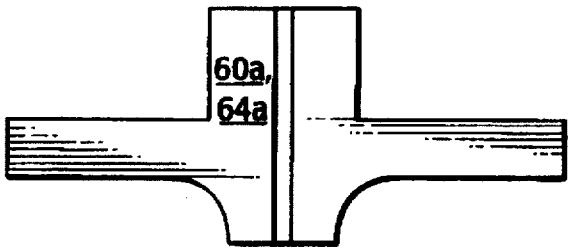
FIG. 10 is a side elevational view of an alternate embodiment of a side tamper.

In a first embodiment of the apparatus, a single reciprocating right tamper 64 is connected to a piston cylinder assembly 65, for example. Once the sheet is fully positioned within the alignment apparatus, right tamper 64 reciprocates toward left tamper 60, to the position shown in dotted line. The sheet is sandwiched between reciprocating right side tamper 64 and a stationary left tamper 60. This will align the parallel folds with each other and align the overlapping strips with each other. A folder blade 76, which is supported in guide slots 78*a* and 78*b* in the tampers, moves downwardly to remove the sheet from the alignment apparatus and place it between fold rollers 70 and 72. These fold rollers are rotatably mounted on respective axles 71 and 73. Fold rollers 70 and 72 rotate in opposite directions to draw the sheet downwardly away from the blade folder to complete the final fold enclosing the adhesive. As can be seen most clearly in FIG. 7, left tamper 60 has a downwardly extending V-shaped nib 84 and a horizontally extending V-shaped nib 86. Nib 84 extends down between fold roller 70 and 72 to continuously guide the sheet from the alignment apparatus through the fold rollers. Nib 86 extends between fold roller 70 and upper pulley 56 to completely guide the sheet during its entrance into the alignment apparatus and subsequent exit through the fold rollers. Pulley 56 and fold rollers 70 and 72 are only as wide as the alignment apparatus and fit between tampers 60 and 64. A part of tamper 60 extends beyond the diameter of fold rollers 70 and 72 and upper pulley 57, as shown in dotted line. Tamper 64 has the same general configuration as tamper 60. Nibs 84 and 86 are optionally U-shaped or rectangular, as shown in tampers 60*a* and 64*a* of FIG. 10. Nib 84 extends down to the central axis of axis of axles 71 and 73.

In the second embodiment, left tamper 60 is also a reciprocating tamper. Both tampers 60 and 64 are retracted as the sheet enters the alignment apparatus. Tampers 60 and 64 then extend toward each other to align the parallel folds and the overlapping strip of the sheet. Blade 76 then moves the sheet down into the fold rollers, as discussed above.

After the side guides have extended to engage the sides of the sheet, an adhesive applicator 59 places a small dot of adhesive onto the sheet, as can be seen in FIGS. 4A, 4B and in FIG. 7 in dotted line. FIG. 8 shows the configuration of side guides 60 and 64 extending above roller 72 and supporting the sides of knife 76. Slots 81*a* and 81*b* allow blade 76 to be raised and lowered without interfering with top guide 62. An additional central slot 80, is positioned between slots 81A and 81B. Central slot 80 is aligned with adhesive applicator 59. The dot of adhesive is able to flow onto the desired surfaces without interference from blade 76. As was mentioned earlier, cross folder 52 may form two or more buckle folds on the sheet. Similarly, two or more folder blades may be provided in series to perform multiple blade folds on the sheet. As can be appreciated, many combinations of buckle folds and blade folds are possible to achieve the secured insert according to the invention.

Figure 9:
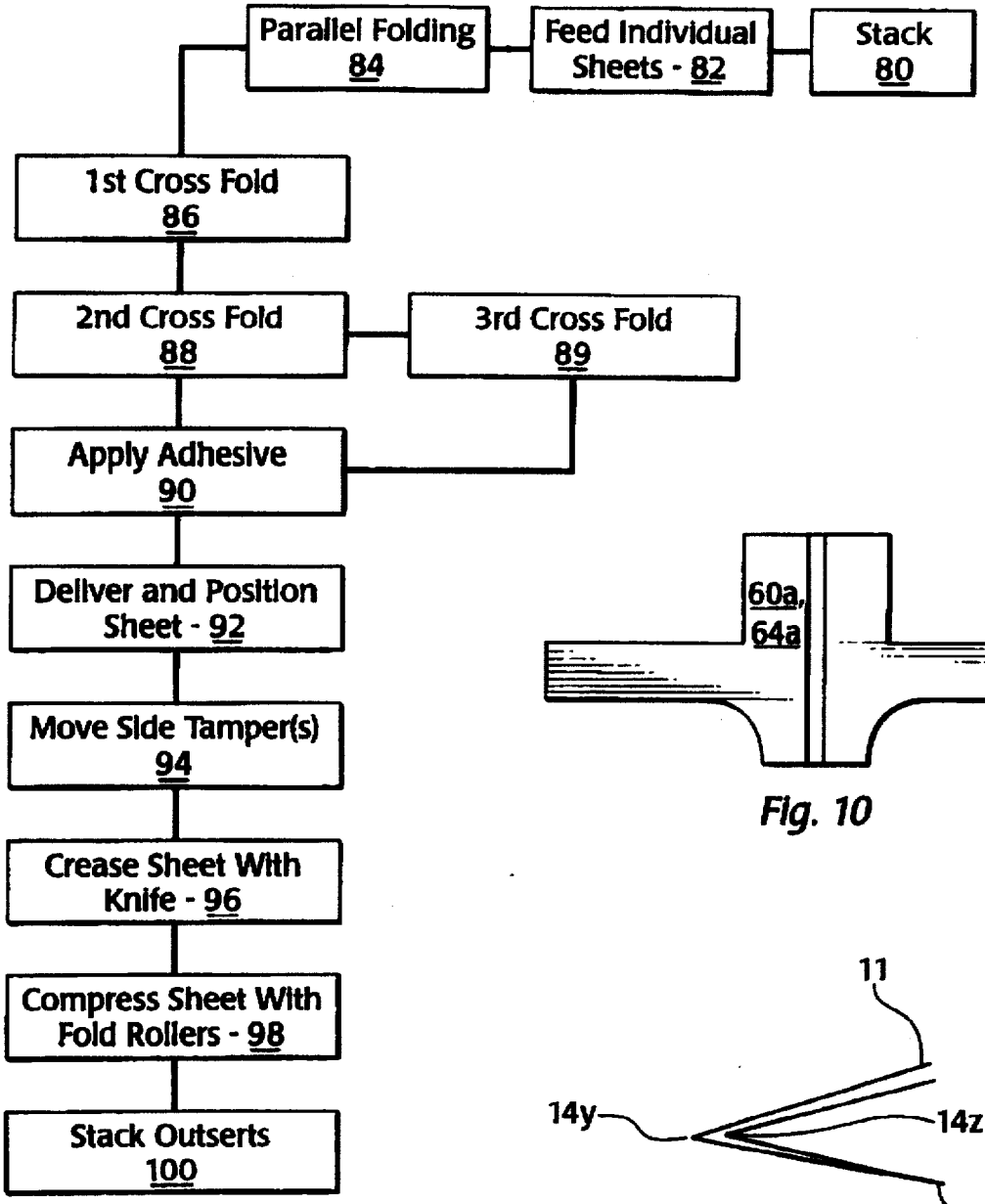
FIG. 9 is a flow chart detailing the steps in the process according to the invention.

FIG. 9 is a flow chart showing the method according to the invention. Individual sheets 10 are arranged in a stack in step 80. In step 82, individual sheets are fed into the parallel folder. In stop 84, parallel folding takes place. The sheet is then transported into the cross fold where one and two cross folds are executed in steps 86 and 88. An optional cross fold may be executed at this point as step 89. It should be understood that the cross folds executed in steps 86 and 88 will most likely be a buckle fold while the cross fold executed in step 89 may be a buckle fold or a blade fold. Next, an adhesive is applied in step 90. In step 92, the sheet is delivered and positioned within the alignment apparatus. Alternatively, the adhesive may be applied following step 92. One or both of the side tampers are extended outwardly in step 94. The sheet is creased with a folder blade in step 96 and compressed with the fold rollers in step 98. The outserts are then stacked in a row or column in final step 100.

While several embodiments of the present invention have been shown and described, it is to be understood that many changes and modifications may be made thereunto without departing from the spirit and scope of the invention as defined in the appended claims.

What is claimed is:

1. A folded closed leaflet formed from a printed sheet having a longitudinally extending edge, the leaflet comprising:

a plurality of parallel fold lines formed in the sheet dividing the sheet into overlapping strips, each parallel fold line extending between a first free end and a second spaced opposite free end;

a first cross fold perpendicular to said plurality of parallel fold lines forming substantially equal halves of said strips and positioning said second free end adjacent said first free end to form a combined free end; said combined free end bordering a first panel and said first cross fold bordering a second panel with a third panel disposed between said first and second panels;

a second cross fold superimposing said first panel onto said third panel;

a third cross fold folding said first and third panels in half to superimpose a first portion of said first and third panels onto a second portion of said first and third panels to form a stack with four panels;

a final cross fold superimposing said second panel onto said stack of four panels formed from said folded first and third panels; and adhesive means interior of the leaflet joining said second panel to said third panel to form the closed leaflet.

2. An apparatus for folding a printed sheet, having a longitudinally-extending edge, into a closed, secured outsert as the sheet is conveyed in a downstream direction, comprising:

means for supporting a plurality of printed sheets in a stack and individually feeding sheets from the stack;

parallel folding means for forming a plurality of parallel fold lines in an individual sheet fed from the stack to divide the sheet into overlapping strips before discharging the sheet in a first direction perpendicular to the parallel fold lines, wherein the parallel fold lines are parallel to the longitudinally-extending edge;

conveyor means downstream from said parallel folding means for feeding the folded sheet in a second direction which is parallel to the longitudinally-extending edge and perpendicular to the first direction;

cross folding means downstream from said conveyor means for:

(i) forming a first cross fold in the sheet perpendicular to said parallel fold lines to divide the strip into substantially equal halves including a free end opposite said first cross fold;

(ii) forming a second cross fold in the sheet; and (iii) discharging the sheet in the second direction with said second cross fold facing the second direction, said first cross fold facing away from the second direction with said free end positioned therebetween;

adhesive application means downstream from said cross folding means for dispensing an adhesive onto a section of the sheet;

blade folder means downstream from said cross folding means for forming a third cross fold between said first and second cross folds to enclose the free end and the adhesive before discharging the closed, secured outsert in the second direction, wherein said third cross fold is adjacent said free end and positions said first cross fold adjacent said second cross fold, said blade folder means comprising:

(i) a stationary front stop for contacting said second cross fold and positioning the sheet along the second direction;

(ii) two side tampers for contacting said parallel fold lines and positioning the sheet along the first direction;

(iii) a first and second fold rollers rotatably mounted on first and second roller axles and positioned below said side tampers, said roller axles extending parallel to the first direction;

(iv) a folder blade slidably disposed between said side tampers for creasing the sheet and feeding the sheet from said tampers to said rollers;

(v) an input pulley rotatably mounted on a pulley axle and positioned generally above said first fold roller for feeding the sheet toward said front stop;

(vi) each of said side tampers has a first nib extending between said pulley axle and said first roller axle and a second nib extending downwardly between said first roller axle and said second roller axle; and means located downstream of said blade folder means for stacking the closed, secured outserts in a row.

3. The apparatus according to claim 2, wherein said side tampers are reciprocating side tampers which extend toward and retract away from each other, said reciprocating side tampers are retracted when the sheet is fed into said blade folder means and extend to press the sheet therebetween to align said parallel folds before creasing the sheet.

4. The apparatus according to claim 2, wherein one of said side tampers is a stationary side tamper and the other of said side tampers is a reciprocating side tamper which extends toward and retracts away from said stationary side tamper, said reciprocating side tamper is retracted when the sheet is fed into said blade folder means and extends to press the sheet against said stationary side tamper and align said parallel folds before creasing the sheet.

5. The apparatus according to claim 4, wherein said blade folder means comprises:

a cantilevered top guide connected to said stationary front stop and extending toward said input pulley to contact and guide the sheet;

wherein said blade includes a first aperture for accommodating said top guide and a second aperture for aligning with the adhesive to avoid contact therewith.

6. A method for folding a printed sheet with a longitudinally-extending edge into a closed, secured outsert, the method comprising the steps of:

forming a plurality of parallel fold lines in the sheet to divide the sheet into overlapping strips;

forming a first cross fold perpendicular to said parallel fold lines to divide the strips into substantially equal halves including a free end opposite said first cross fold;

forming a second cross fold in the sheet to position the free end between said first cross fold and said second cross fold;

positioning the sheet within an alignment apparatus with said second cross fold placed against a stationary front stop and at least one of said parallel folds placed adjacent a stationary side tamper;

sliding a reciprocating side tamper against the remaining parallel folds to press the sheet against the stationary side tamper;

providing a folder blade with an operating edge and two sides adjacent the operating edge;

supporting the two sides of the folder blade within slots formed in the side tampers;

dispensing an adhesive onto a section of the sheet; and sliding the operating edge of the blade against the sheet to move the sheet out of the alignment apparatus and into the fold rollers to create a third cross fold between said first cross fold and said second cross fold to enclose the free end and the adhesive to provide a closed, secured outsert.

7. The method according to claim 6, wherein said parallel fold lines are parallel to the longitudinally-extending edge, wherein said first, second and third cross folds are parallel to each other and perpendicular to the longitudinally-extending edge; wherein said third cross fold is adjacent the free end and positions said first cross fold adjacent said second cross fold.

8. The method according to claim 7, further comprising the steps of:

feeding individual sheets from a stack, before said step of forming a plurality of parallel fold lines; and stacking the closed, secured outserts in a column, after said step of forming a third cross fold.

9. A method for folding a printed sheet with a longitudinally-extending edge into a closed, secured outsert, the method comprising the steps of:

forming a plurality of parallel fold lines in the sheet to divide the sheet into overlapping strips;

forming a first cross fold perpendicular to said parallel fold lines to divide the strips into substantially equal halves including a free end opposite said first cross fold;

forming a second cross fold in the sheet to position the free end between said first cross fold and said second cross fold;

positioning the sheet within an alignment apparatus with said second cross fold placed against a stationary front stop;

sliding a pair of reciprocating side tampers against opposed parallel folds to align the overlapping strips;

providing a folder blade with an operating edge and two sides adjacent the operating edge;

supporting the two sides of the folder blade within slots formed in the side tampers;

dispensing an adhesive onto a section of the sheet; and sliding the operating edge of the blade against the sheet to move the sheet out of the alignment apparatus and into the fold rollers, to create a third cross fold between said first cross fold and said second cross fold, to enclose the free end and the adhesive to provide a closed, secured outsert.

* * * * *